US006562456B1

(12) United States Patent
Bruner et al.

(10) Patent No.: US 6,562,456 B1
(45) Date of Patent: May 13, 2003

(54) SPLITTABLE ELASTANE YARNS

(75) Inventors: Ben Bruner, Ravanel, SC (US); James F. Heslep, Pocopson, PA (US); Hans-Josef Behrens, Dormagen (DE); Konrad Schmitz, Pulheim (DE); Karlheinz Wolf, Köln (DE)

(73) Assignee: Bayer Faser GmbH, Dormagen (DE)

( * ) Notice: Subject to any disclaimer, the term of this patent is extended or adjusted under 35 U.S.C. 154(b) by 0 days.

(21) Appl. No.: 08/960,694

(22) Filed: Oct. 29, 1997

Related U.S. Application Data

(62) Division of application No. 08/648,473, filed on May 16, 1996, now Pat. No. 5,723,080.

(30) Foreign Application Priority Data

Jul. 27, 1995 (DE) ..... 195 27 436

(51) Int. Cl.[7] ..... D01F 6/00

(52) U.S. Cl. ..... 428/364; 428/357; 57/225; 57/226

(58) Field of Search ..... 428/357, 364; 57/225, 226; 66/196

(56) References Cited

U.S. PATENT DOCUMENTS

| | | | | | |
|---|---|---|---|---|---|
| 3,596,458 | A | * | 8/1971 | Nakano | 57/156 |
| 3,657,873 | A | * | 4/1972 | Gibson et al. | 57/152 |
| 4,411,142 | A | * | 10/1983 | Regenstein | 66/196 |
| 4,509,320 | A | * | 4/1985 | Maeda | 57/225 |

* cited by examiner

*Primary Examiner*—N. Edwards
(74) *Attorney, Agent, or Firm*—Norris McLaughlin & Marcus

(57) ABSTRACT

An elastane multifilament yarn havig two to six individual filaments which, when being unwound from a bobbin, is splittable into individual filaments, is produced by a process wherein multihole spinning jets are deployed in the spinning head of a conventional dry spinning apparatus, laminarizing the spinning gas flow to prevent entanglement of the individual filaments and passing the resulting yarn through a thread guide with one opening per individual filament.

2 Claims, No Drawings

SPLITTABLE ELASTANE YARNS

This application is a division of application Ser. No. 08/648,473, filed on May 16, 1996, now U.S. Pat. No. 5,723,080 issued Mar. 3, 1998.

The invention relates to a manufacturing process for splittable elastane multifilament yarns whereby coalescence of the individual filaments forming the yarn due to fusion, sticking or mechanical entangling or plying is prevented. The individual filaments obtainable from the process can be split after take-off the multifilament yarn bobbin and be further processed separately in textile production processes.

Elastane fibers are fibers consisting of segmented polyurethanes in at least 85% by weight. Their typical property spectrum is the result of using polyurethane-polyureas from oligomeric polyester- or polyether-diols, aromatic diisocyanates and short-chain aliphatic diamines. Filament formation is customarily effected by spinning solutions of the polyurethanes by the wet spinning process or preferably by the dry spinning process, suitable solvents in both cases being polar solvents such as dimethyl sulphoxide, N-methylpyrrolidone, dimethylformamide or preferably dimethylacetamide.

Commercial elastane yarns are well known. Owing to their elastic properties they are used for manufacturing functionalized textile products, i.e. articles exhibiting a combination of extensibility and retractive or shaping power. For this, the elastane filament yarn is combined, for example by overwrapping, overspinning or interlacing, with other inelastic yarns to form combination yarns, or the elastane filament yarn is knitted up directly with inelastic yarn.

It order that these processing operations may proceed without problems, the elastane yarns have to be virtually free of fluff, thin places and defects. The prior art teaches that the elastane yarns are produced as coalesced multifilament yarns. This means that the individual filaments forming the overall yarns are virtually stuck together during spinning, for example in the dry spinning process. A process for producing coalesce elastane yarns is described for example in U.S. Pat. No. 3,094,374 and European Patent Application 182,615. The former expressly describes the advantages of a multifilament with high interfilamentary adhesion with regard to consistent processing and discloses methods for achieving this property spectrum.

It was therefore not to be expected that elastane multifilament yarns having good processing properties could be obtained if the process used for producing them is deliberately geared to minimize or eliminate interfilamentary adhesion.

Laid-Open Document JP 03-059 112 describes bundled polyurethane multifilaments or monofilaments which are wound up on a bobbin in an oriented manner so that the bundled multi- or monofilaments require 15 mg or less for separation from the bobbin. They are further processed as separate multifilaments or monofilaments at a speed of at least 150 m/min. These products are obtained by subjecting the dry-spun filaments to cooling below 60° C. and additionally adding a metal soap to the product. It is immaterial for the process of JP 03-059 112 whether multi- or monofilaments are separated.

It is an object of the present invention to produce multifilament yarns which are splittable into their individual filaments on unwinding from the bobbin. These individual filaments must not be mutually plied, entangled, or locally or longitudinally stuck together. The problem is to completely suppress such rare effects which occur every several hundred meters.

This object is achieved by a manufacturing process for producing splittable elastane multifilament yarns from conventional polyurethane-polyureas by means of a modified dry spinning process, which is characterized by the steps of 1) deploying in the spinning head of a conventional dry spinning apparatus one or more multihole spinning jets whose individual capillaries are located on one plate, the distance x between capillaries on one plate and the distance y between capillaries on adjacent multihole spinning jet plates conforming to the following relationship:

$$40\ \text{mm} < x < y < 500\ \text{mm},$$

2) laminarizing the spinning gas flow in the dry spinning apparatus to prevent entangling of the individual filaments from one multihole jet and from adjacent multihole jets, 3) passing the resulting elastane yarns leaving the spinning shaft through a first thread guide with one opening per individual filament and then through a second thread guide which gathers a plurality of individual filaments together to form a multifilament, and 4) winding up the multifilament yarn.

The polyurea-polyurethanes are prepared by methods known per se. An advantangeous method is the synthesis of the fiber raw materials by the prepolymer process, in which, in a first step, a long-chain diol is reacted, in a solvent or in the melt, with a diisocyanate to form a prepolymer so that the reaction product contains isocyanate end groups (NCO groups).

Preferred long-chain diols are polyesterdiols on the one hand and polyetherdiols on the other. It is also possible to choose mixtures of the two kinds of diols. These generally have a number average molecular weight of 1000–6000.

Suitable polyesterdiols are for example dicarboxylic acid polyesters which may contain not only a plurality of different alcohols but also different carboxylic acids. Of particular suitability are copolyesters of adipic acid, hexanediol and neopentylglycol in a molar ratio of 1:0.7:0.43. Suitable polyesters have a molecular weight of 1000–4000.

Suitable polyetherdiols are for example polytetramethylene oxide diols, preferably with a molecular weight of 1000–000 (all stated molecular weights are number averages, unless otherwise indicated).

It is also possible to use polyester- and/or polyether-diols in combination with diols which contain tertiary amino groups. Particularly suitable are for example N-alkyl-N,N-bishydroxyalkylamines. Examples are the compounds:

4-tert-butyl-4-azaheptane-2,6-diol, -methyl-4-azaheptane-2,6-diol, -ethyl-3-azapentane-1,5-diol, -ethyl-2-dimethylaminoethyl-1,3-propanediol, -tert-pentyl4-azaheptane-1,6-diol, 3-cyclohexyl-3-azapentane-1,5-diol, 3-methyl-3-azapentane-1,5-diol, 3-tert-butylmethyl-3-azapentane-1,5-diol and 3-tert-pentyl-3-azapentane-1,5-diol.

The elastane raw materials are synthesized using the customary aromatic diisocyanates in admixture with small proportions of aliphatic and/or cycloaliphatic diisocyanates, if desired. Particularly good results are obtained with the following diisocyanates:

2,4-toluylene diisocyanate and also corresponding isomer mixtures, and 4,4'-diphenylmethane diisocyanate (MDI) or corresponding isomer mixtures. It is of course possible to use mixtures of aromatic diisocyanates.

Another form of the synthesis of elastane raw materials comprises mixing polyester- and polyether-polyurethane prepolymer and then reacting in a conventional manner to form polyurea-polyurethanes. The mixing ratio of polyester- and polyether-diols advantageous for the particular technical purpose is easily determined in preliminary experiments.

In the polyurea-polyurethane synthesis, the urea groups are introduced into the macromolecules by a chain-extending reaction. Customarily, the prepolymers ("macrodiisocyanates") synthesized in the prepolymer stage to contain NCO end groups are reacted with diamines in solution. Suitable diamines are for example ethylenediamine, tetramethylenediamine, 1,3-cyclohexanediamine, isophoronediamine and also mixtures thereof. By using a small amount of monoamines, for example diethylamine or dibutylamine, during the chain extension, it is possible to achieve the molecular weight desired for the polyurea-polyurethanes. The chain extension itself can be carried out batchwise or continuously and with or without the use of $CO_2$ as retarder.

A mixture of polyester- and polyether-polyurethane-ureas can also be formed following completion of the synthesis of the individual components.

The reactions are customarily carried out in an inert polar solvent, such as dimethylformamide or dimethylacetamide.

The polymer solution intended for spinning may additionally include a whole series of customary additives, for example antioxidants and light stabilizers against polymer degradation or discoloration, also stabilizers against nitrogen oxide yellowing, pigments, for example titanium dioxide or ultramarine blue, dyes, processing aids such as lubricants and abhesives based on alkali or alkaline earth metal stearates, internal release agents based on polydialkylsiloxanes and/or polyether polysiloxanes, and also additives against chlorinated water degradation, for example zinc oxide.

The spinning solutions with a solids content of 20 to 40% by weight, preferably 22 to 30% by weight, based on fiber polymer, and a viscosity of 50 to 350 Pa·s at 25° C. are subjected according to the invention to a dry spinning process which may, for example, correspond to the embodiment disclosed in DE Patent 3,534,311.

DE 3,534,311 C2 describes a spinning head for producing elastomer threads, comprising spinning jets with one or more capillaries, feed lines for the liquid material to be spun, a spinning gas supply and distribution system and also a process, especially a dry spinning process, for producing elastomer threads from a spinning solution.

DE 3,534,311 C2 claims a spinning head comprising spinning jets having one or more capillaries, feed lines for the material to be spun, and a spinning gas supply and distribution system, characterized in that the spinning gas supply consists of a central gas pipe and the spinning gas distribution system consists of a cylindrical chamber in which the gas pipe ends; whose diameter is at least three times the diameter of the central gas pipe; whose height is not more than 25% of its diameter; which has a gas-permeable floor with a free area of 2 to 15%; and which, below the central gas pipe, accommodates an impingement plate system consisting of a plurality of overlapping circular rings graded in diameter in a spaced-apart horizontal and concentric arrangement and a circular plate.

The process of the invention makes available splittable elastane multifilament yarns with two to six individual filaments and an overall linear density of 15 to 120 dtex. A preferred embodiment of the process of the invention provides elastane multifilament yarns having two individual filaments and a total linear density of 20 to 50 dtex.

Cooling of the filaments similar to JP 03-059 112 is not relevant for the process of the invention and its purpose. By contrast, however, the herein-described configuration of the spinning jet geometry and the laminarization of the gas flow in the spinning shaft, as described for example in DE Patent 3,534,311, is decisive. This is the only way of ensuring that the extrudate filaments, which are still plastic at the start of the spinning shaft passage, do not come into contact with one another. Whereas JP 03-059 112 describes a kind of aftertreatment, the present invention is directed to the domain of the spinning process (spinning jet and shaft). Hence the present process is simpler in that it does not require the additional step of separate cooling.

The elastane multifilament yarn, wound on a bobbin, can be used in processing techniques in which an individual elastane filament is employed if the multifilament yarn is split into individual filaments before or during processing. Examples of such processing techniques are circular knitting or the manufacture of combination yarn with a core of elastane yarn and an overspun, overblown or overwrapped sheath of nonelastic yarn, for example nylon or cotton. The separation into individual filaments of the elastane multifilament yarns of the present invention takes place between the elastane delivery system and the overspinning, overblowing or overwrapping station. The splitting is effected by simply introducing the separated individual filaments into their respective processing elements and starting the processing operation. If necessary, the process of separation can be further augmented by disposing pins or mandrels upstream of the processing elements.

The elastane multifilament yarns of the invention exhibit high uniformity and an excellent processing behavior and do not differ from conventionally produced elastane yarn spun directly to the final linear density. The splittability, moreover, makes it possible to create, from one spinning station, a multiple of elastane yarn of a certain individual filament linear density corresponding to the number of individual filaments, which considerably increases the efficiency of the manufacturing process, especially the space-time yield. This means that this manufacturing process affords, per unit time, an amount of very fine linear density elastane yarn which is a multiple of that obtained by employing a conventional spinning process leading directly to the final linear density.

EXAMPLES

The examples which follow illustrate the invention.

In all examples, the elastane fiber polymer is obtained from a polytetramethylene ether α,ω-diol having a number average molecular weight of 2000, for example Terathane 2000 from DuPont de Nemours, capped with methylene bis(4-phenylisocyanate) (MDI, Desmodur 44 from Bayer AG) to form an NCO prepolymer and chain-extended with a mixture of ethylenediamine (EDA) and diethylamine (DEA) to form the polymer. The elastane fiber polymer was prepared by essentially the same process for each of the examples which follow.

530 parts by weight of polyetherdiol of molecular weight 2000 are mixed at 25° C. with 359 parts by weight of dimethylacetamide and 108 parts by weight of MDI, heated to 50° C., and held at that temperature for 95 min. The result is an NCO prepolymer containing 2.20% by weight of isocyanate end groups. The prepolymer is then cooled to 20° C. and diluted with 598 parts by weight of DMAC.

100 parts by weight of this dilute prepolymer are intensively mixed in a continuous reactor with 31.67 parts by weight of DMAC, 0.58 parts by weight of EDA and 0.66 parts by weight of a 10% strength solution of DEA in DMAC, the reaction yielding a polymer solution containing 30% by weight of solids and having a viscosity of 124 Pa·s at 50° C. and an inherent viscosity $\eta_{inh}$ of 1.4 dl/g.

This spinning solution was admixed with the following additives via various master batches (all data in % by weight based on the fiber solids): 1% by weight of Cyanox 1790® (from Cytec, USA, stabilizer), 3.75% of basic polyurethane from dicyclohexylmethane diisocyanate and bis-2-hydroxypropyl-N-methylamine (nitrogen oxide quencher), 0.05% by weight of titanium dioxide, 0.2% by weight of magnesium stearate (lubricant), 0.3% by weight of polyethersiloxane Silwet L 7607 (from OSI, antistat) and optionally 1% by weight of polydimethylsiloxane (internal release agent).

Example 1

A polyurethane-polyurea spinning solution was prepared as described above. It contained 0.35% by weight of magnesium stearate based on the solids and 0.98% by weight of polydimethylsiloxane (Baysilone M 100, commercial product from Bayer AG), 0.35% by weight of siloxane wetting agent (Silwet L 7607, commercial product from OSI Inc.) and 0.05% by weight of titanium dioxide (Rutil RKB 2 from Bayer AG). The solution was dry-spun according to the invention on a spinning apparatus accommodating in its spinning head 8 jets each having two holes 0.3 mm in diameter in an arrangement such that their spacing on the common jet plate was 54 mm and the distance between two jet holes on adjacent plates was at least 62 mm. The vertical spinning apparatus had temperaturecontrolled wall surfaces, which were held at about 220° C. Spinning gas was fed into the spinning head through a fine wire mesh at 55 $Nm^3/h$ at 290° C. in laminar flow. At the lower end of the spinning apparatus, the individual filaments formed were passed through a first thread guide having circular ceramic eyelets and then pairs of these individual filaments were combined in a second thread guide element having a comblike shape into a multifilament yarn. The inultifilament yarns then pass over a delivery godet, a spin finish oil application roll and a second godet before being wound up at 880 m/min to form bobbins with a yarn weight of 560 g. The multifilament yarn of the invention had a linear density of 45 dtex.

The yarn mentioned was then used in a manufacturing process for combination yarn. For this, the elastane multifilament yarn of the invention is placed on an overwrapped yarn machine as described for example by H. Gall and M. Kausch in chapter 13 Polyurethane Elastomer Fibers in Becker/Braun: Kunstoff-Handbuch vol. 7 Polyurethanes, Carl Hanser Verlag, Munich, 1993, page 689, and processed with splitting into two adjacent hollow spindles into an overwrapped yarn with nylon yarns as sheath. The bobbins unwound without breakage in the splitting zone and in the transportation system and spindle region of the overwrapping machine and produced satisfactory combination yarn.

These novel threads also proved splittable in a trial on a blown-yarn machine where feed bobbins were processed into individual filament end bobbins at a take-off speed of above 100 m/min.

Example 2

Example 1 was repeated using a spinning solution containing 0.25% by weight of magnesium stearate, 0.7% by weight of polydimethylsiloxane and 0.25% by weight of siloxane wetting agent. The spinning jets used had a hole spacing of 34 mm between holes on the same plate. At the end of the spinning apparatus, the 8 multifilament yarns, each consisting of two filaments, were passed through a conventional twisting element, in this case an air twisting jet under conditions for less false twist compared with the normal process. The result was 45 dtex 2 filament yarn which was splittable by hand.

On the overwrapping machine (see Example 1), while processing under the conditions for producing overwrapped yarn (take-off around 5 m/min), a broken end occurred about every 10 minutes. Investigations showed that the individual filaments of the multifilament yarn had become fused together at the point of break.

It is clear from the examples that production of the elastane multifilament yarn of the invention requires adherence to the dry spinning process of the invention. It is presumed that the splittable elastane multifilament yarns can only be produced if the geometric and physical conditions along the yarn path through the spinning apparatus are such that touching, entangling or otherwise intensive contacting is avoided.

It will be understood that the specification and examples are illustrative but not limitative of the present invention and that other embodiments within the spirit and scope of the invention will suggest themselves to those skilled in the art.

What is claimed is:

1. An elastane multifilament yarn with two to six individual filaments which, upon being unwound from a bobbin, is splittable into individual filaments and which is produced by an improved dry spinning process for producing an elastane multifilament yarn, wherein an elastane solution is dry spun to form the yarn, in which the improvement comprises reducing or preventing interfilamentary adhesion by 1) deploying in the spinning head of a conventional dry spinning apparatus at least one multihole spinning jet whose individual capillaries are located on one plate, the distance x between capillaries on one jet plate and the distance y between capillaries on any adjacent multihole spinning jet plates conforming to the relationship 40 mm<x<y<500 mm, 2) laminarizing the gas flow in the dry spinning apparatus to prevent entangling of the individual filaments from adjacent multihole jets, 3) passing the resulting elastane yarns leaving the spinning shaft through a first thread guide with one opening per individual filament and then through a second thread guide which gathers a plurality of individual filaments together to form a multifilament, and 4) winding up the multifilament yarn, whereby the resulting elastane filaments are free from adhesion to one another.

2. An elastane multifilament yarn with two to six individual filaments which, upon being unwound from a bobbin, is splittable into individual filaments and which is produced in accordance with the process of claim 1, wherein the gas flow is laminarized by using a spinning head comprising a spinning jet having at least one capillary, feed line for the material to be spun, and a spinning gas supply and distribution system, and wherein the spinning gas supply comprises a central gas pipe, and the spinning gas distribution system comprises a cylindrical chamber in which the gas pipe ends; whose diameter is at least three times the diameter of the central gas pipe; whose height is not more than 25% of its diameter; which has a gas-permeable floor with a free area of 2 to 15%; and which, below the central gas pipe, accommodates an impingement plate system comprising a plurality of overlapping circular rings graded in diameter in a spaced-apart horizontal and concentric arrangement and a circular plate and wherein said first thread guide used is an eyelet plate and said second thread guide used is a guide of a comb type, and the elastane multifilament yarn comprises two individual filaments and has a linear density of 30–50 dtex.

* * * * *